US005143587A

United States Patent [19]

Endoh et al.

[11] Patent Number: 5,143,587

[45] Date of Patent: Sep. 1, 1992

[54] METHOD FOR ETCHING AN ALUMINUM FOIL FOR AN ELECTROLYTIC CAPACITOR

[75] Inventors: Eiji Endoh, Yokohama; Haruo Jinbo, Fujisawa, both of Japan

[73] Assignees: Asahi Glass Company Ltd., Tokyo; Elna Company Ltd., Fujisawa, both of Japan

[21] Appl. No.: 825,092

[22] Filed: Jan. 24, 1992

[51] Int. Cl.[5] ..... C25F 3/04

[52] U.S. Cl. ..... 204/129.85

[58] Field of Search ..... 204/129.85

[56] References Cited

U.S. PATENT DOCUMENTS 4,821,153 4/1989 Kuwae et al. ..... 361/505

*Primary Examiner*—T. M. Tufariello

*Attorney, Agent, or Firm*—Oblon, Spivak, McClelland, Maier & Neustadt

[57] ABSTRACT

A method for etching an aluminum foil for an aluminum electrolytic capacitor, which comprises immersing the aluminum foil in an etching solution containing a polymer electrolyte having cation exchange groups dissociable in the etching solution, and applying an electric current thereto.

24 Claims, No Drawings

METHOD FOR ETCHING AN ALUMINUM FOIL FOR AN ELECTROLYTIC CAPACITOR

The present invention relates to a method for etching an aluminum foil for an electrolytic capacitor. More particularly, it relates to an etching method whereby the electrostatic capacity of an electrolytic capacitor can be remarkably increased by an increase of the surface area of the aluminum foil by etching, and an aluminum foil treated by such an etching method, an aluminum foil obtained by anodic oxidation or electrochemical oxidation thereof and an electrolytic capacitor using such an aluminum foil.

An aluminum foil for an electrolytic capacitor is subjected to electrochemical or chemical etching treatment to enlarge the effective surface area and then to the anodic oxidation thereby to increase the electrostatic capacity of an electrolytic capacitor using such a foil.

Capacitors of this type include those for low, medium and high voltages depending upon the ranges of the voltages to be used. For etching of an aluminum foil for a capacitor of a low voltage of up to 100 V (hereinafter referred to simply as etching for low voltage), it is common to employ an alternate current and to conduct etching usually in two or three stages (U.S. Pat. No. 4,276,129). For etching of an aluminum foil for a capacitor of a medium voltage of from 100 to 250 V or of a high voltage of more than 250 V (hereinafter referred to simply as etching for medium or high voltage respectively), it is common to employ a direct current and to conduct etching usually in two or three stages (Japanese Unexamined Patent Publications No. 212427/1989 and No. 212428/1989).

However, in the conventional etching techniques, dissolution of the aluminum foil surface tends to proceed preferentially over the growth of the etching holes. Therefore, there has been a drawback that it is difficult to deepen the etching holes even if the electric current for etching is increased, and it is not possible to increase the surface area to a desired extent. For example, it has been very difficult to increase the electrostatic capacity even slightly by 0.1 $\mu F/cm^2$ in the case of a capacitor for a medium or high voltage.

It is an object of the present invention to overcome such drawbacks and to provide a method for producing an aluminum foil for an electrolytic capacitor, whereby the surface dissolution of the aluminum foil is suppressed, and etching can effectively be conducted.

The present invention provides a method for etching an aluminum foil for an aluminum electrolytic capacitor, which comprises immersing the aluminum foil in an etching solution containing a polymer electrolyte having cation exchange groups dissociable in the etching solution, and applying an electric current thereto.

In the present invention, preferably, in a method for etching an aluminum foil for an aluminum electrolytic capacitor comprising plural stages of etching, at least one stage of etching is conducted in the presence of a polymer electrolyte having cation exchange groups dissociable in the etching solution, and the aluminum foil is subjected to etching by an application of a direct current or an alternate current.

In the present invention, the polymer electrolyte having cation exchange groups may be a polymer electrolyte dispersible or soluble in the etching solution. However, it is preferred to use a soluble linear polymer having no crosslinked structure or a polymer electrolyte having a very little crosslinked structure.

In general, as the molecular weight increases, the polymer tends to be hardly soluble in the etching solution. However, the higher the density of cation exchange groups of the polymer electrolyte i.e. the larger the ion exchange capacity, the higher the solubility even when the molecular weight increases. Further, if the cation exchange groups are of a strong electrolyte, the polymer tends to be more readily soluble. The molecular weight is preferably at least 500, more preferably at least 5,000, most preferably from 10,000 to 2,000,000.

In the present invention, the density of cation exchange groups i.e. the ion exchange capacity of the polymer electrolyte, is preferably within a range of from 0.001 to 20 meq/g dry polymer, more preferably from 0.1 to 18 meq/g dry polymer.

The function of the polymer electrolyte having cation exchange groups in the present invention is not clearly understood. However, it is believed that part or most of the cation exchange groups of the electrolyte dissociates in the etching solution, whereby by electrophoresis or diffusion the electrolyte is adsorbed on aluminum to be etched and thus it serves to suppress the dissolution of the aluminum surface. The ion exchange groups dissociable in the etching solution of the polymer electrolyte to be used in the present invention, may be acid groups having a dissociation constant (pK value, F. Helfferich, "Ion Exchange" (1962), p. 86) of less than 4.5, preferably at most 3.0, more preferably less than 1.5. As such acid groups, carboxylic acid groups, phosphonic acid groups, phosphinic acid groups or sulfonic acid groups, may be mentioned as preferred examples. It is particularly preferred to use a polymer electrolyte having a small pK value, particularly the one having strong acid groups.

The monomer unit of the polymer electrolyte to be used in the present invention may be a monobasic acid or a polybasic acid. Preferred examples of such a polymer electrolyte include a polyacrylic acid, a polymethacrylic acid, a polystyrenesulfonic acid, a phenolsulfonic acid-aldehyde condensation product, a polyvinylsulfonic acid, a poly-n-butylsulfonic acid, a polydiisopropylsulfonic acid, a polynaphthalenesulfonic acid, a polystyrenephosphinic acid, a polystyrenephosphonic acid, a polyethylenephosphinic acid, a polyvinylphosphonic acid, a toluenesulfonic acid-aldehyde condensation product, a benzenesulfonic acid-aldehyde condensation product or a salt such as an alkali metal salt capable of being converted to the above acid groups in the etching solution. The polymer electrolyte may be a mixture of a plurality of the above electrolytes.

The polymer electrolyte can be prepared by homopolymerization of a monomer having a cation exchange group. Otherwise, it may be prepared by copolymerizing a monomer having a cation exchange group with a monomer having no such a cation exchange group, as in the case of a perfluorosulfonic acid polymer of the formula (I) or a perfluorocarboxylic acid polymer of the formula (II), or it can be produced by introducing cation exchange groups by sulfonation or phosphonation into a polymer compound having no cation exchange groups.

$$\left(CF_2-CR_2\right)_x\left(CF_2-\underset{\substack{|\\ O(CF_2)_nSO_3H}}{CF}\right)_y \qquad (I)$$

-continued $$\left(CF_2-CR_2\right)_p\left(CF_2-\underset{\underset{O(CF_2)_rCOOH}{|}}{CF}\right)_q \quad \text{(II)}$$

In the formula (I) and (II), x, y, n, p, q and r are selected so that the above-mentioned ion exchange capacity and the molecular weight are satisfied.

The polymer electrolyte having cation exchange groups is added to the etching solution preferably in an amount of from 0.003 to 10 g/l, more preferably from 0.005 to 5 g/l, although the amount varies depending upon the type of the polymer electrolyte to be added.

As the etching solution to be used for etching, various conventional etching solutions including aqueous solution of acid or salt thereof may be employed. Aqueous solution of acid salt includes chloride salt such as ammonium chloride and sodium chloride. Particularly preferred is aqueous solution of hydrochloric acid or nitric acid, and its concentration is preferably from 1 to 30% by weight, particularly from 3 to 20% by weight. When the etching is conducted in a plurality of stages, the same etching solution or different etching solutions may be employed in the respective stages. For example, in the case of an aluminum foil for a medium or high voltage capacitor, an aqueous hydrochloric acid solution is used in the first stage, and an aqueous hydrochloric acid or nitric acid solution is used in the second stage. Further, in order to prevent excessive dissolution of the foil, sulfuric acid, phosphoric acid, oxalic acid or chromic acid may be added to the etching solution in each stage preferably in an amount of from 0.1 to 5% by weight, particularly from 0.5 to 2% by weight, based on the total amount of the etching solution.

The etching treatment of the aluminum foil is usually preferably conducted in a plurality of stages. The above-mentioned polymer electrolyte is added to an etching solution in any one or more of the plurality of stages. For etching for medium or high voltage, it is preferred to add the polymer electrolyte in the second stage, and for etching for low voltage, it is preferred to add the polymer electrolyte in each stage.

Etching is conducted by immersing in an etching solution an aluminum foil or sheet which preferably has a purity of at least 99%, more preferably at least 99.9%, and a thickness of from 10 to 300 μm, more preferably from 20 to 200 μm. An aluminum foil to be etched may be pre-conditioned by immersing it in an aqueous dilute solution of such as hydrofluoric acid or sodium hydroxide whereby the surface of aluminum foil is chemically dissolved. The etching for medium or high voltage is conducted in an etching solution having a liquid temperature of from 50° C. to 110° C., preferably at a current density of from 1 to 50 A/cm$^2$, preferably for from 1 to 50 minutes, using a direct current voltage. The etching for low voltage is conducted in an etching solution preferably having a liquid temperature of from 5° C. to 50° C. using an alternate current voltage of from 1,000 to 7,000 Coulomb/dm$^2$ with a frequency of from 5 to 50 Hz. If the liquid temperature is outside the above range, through-holes are likely to be formed in the foil. If the current density and the time, or the frequency and the quantity of electricity, are outside the above ranges, the foil is likely to dissolve too much, or through-holes are likely to be formed, such being undesirable. Here, the alternate current may be not only the one wherein the voltage waveform or the current waveform is sine, but also a triangle wave, a rectangular wave or the like wherein the waveform periodically changes, or it may be a combination thereof.

When an aluminum foil is subjected to etching in an etching solution containing the polymer electrolyte having cation exchange groups of the present invention, the polymer electrolyte will be adsorbed on the surface of the aluminum foil and thereby effectively suppress the dissolution of the aluminum foil surface. On the other hand, since the polymer electrolyte has a high molecular weight, it can not enter into the etching holes, or its diffusion into the etching holes is substantially slow as compared with the ions such as chloride ions which dissolve aluminum, whereby dissolution of aluminum in the etching holes will not be suppressed. Thus, aluminum substrate in the etching holes will be selectively etched, whereby etching holes can be made deep and large, and the surface area can be increased sufficiently without impairing the mechanical strength of the aluminum foil. The aluminum foil thus treated is useful as an anode and/or cathode foil of a capacitor.

The aluminum foil thus treated by etching treatment will then be subjected to anodic oxidation or electrochemical oxidation treatment. The anodic oxidation treatment is conducted by immersing the aluminum foil in an aqueous solution containing from 5 to 20% by weight of boric acid, preferably at a temperature of from 50° C. to 100° C. for from 10 minutes to 2 hours under an application of a predetermined voltage within a range of from 1 to 650 V. To the aqueous boric acid solution, ammonia or the like may be added as a conductivity-increasing agent, as the case requires. By the anodic oxidation treatment, a dielectric coating film will be formed on the surface of the aluminum foil, and such an aluminum foil is used as a foil for an electrolytic capacitor.

An electrolytic capacitor using such an aluminum foil can be prepared by a conventional method such as method disclosed in e.g. U.S. Pat. No. 4,734,821 or 4,821,153.

Now, the present invention will be described in further detail with reference to Examples and Comparative Examples. However, it should be understood that the present invention is by no means restricted by such specific Examples.

COMPARATIVE EXAMPLE 1

An aluminum foil or sheet having a purity of 99.9% and a thickness of 100 μm was subjected to first stage etching by using, as a first stage etching solution, an aqueous solution having a hydrochloric acid concentration of 5% by weight and a sulfuric acid concentration of 25% by weight and a solution temperature of 80° C. and by applying a direct current at a current density of 30 A/dm$^2$ for 120 seconds. Then, the second stage etching was conducted by using, as a second stage etching solution, an aqueous solution having a hydrochloric acid concentration of 7% by weight and having a solution temperature of 90° C. and by applying a direct current at a current density of 10 Adm$^2$ for 380 seconds. After the first stage and second stage etching, the aluminum foil was subjected to anodic oxidation treatment in an aqueous solution prepared by adding 100 g of boric acid and 4 cc of 28 wt % aqueous ammonia in 1 l of pure water, by applying a direct current voltage of 310 V. Using the anode oxidation treated foil thus obtained, a capacitor for a test was prepared in the following manner, and the electrostatic capacity was measured.

An aluminum anode foil obtained as described above having a length of 10 cm and a width of 1 cm and a commercially available aluminum cathode foil (thickness: 20 μm, length: 11 cm, width: 1 cm) were wound with a separator sheet interposed therebetween, and a capacitor was prepared in accordance with the method (driving fluid: tetraethylammonium-0-phthalate) as disclosed in U.S. Pat. No. 4,821,153.

The electrostatic capacity of this capacitor was measured by a LCR meter (frequency: 120 KHz, temperature: 20° C.) and the electrostatic capacity per unit surface of the aluminum foil (hereunder referred as the capacity) was found to be 1.12 μF/cm$^2$.

EXAMPLE 1

In the second stage etching solution as used in Comparative Example 1, sodium polyacrylate (ion exchange capacity: 10.6 meq/g, average molecular weight: 100,000) was dissolved in a proportion of 1.0 g/l, and etching and anodic oxidation were conducted and the capacity was measured, in the same manner as in Comparative Example 1, whereby the capacity was found to be 1.31 μF/cm$^2$.

EXAMPLE 2

In the second stage etching solution as used in Comparative Example 1, polystyrenephosphonic acid (ion exchange capacity: 5.0 meq/g, molecular weight: 200,000) was dissolved in a proportion of 0.5 g/l, and etching and anodic oxidation were conducted and the capacity was measured, in the same manner as in Comparative Example 1, whereby the capacity was found to be 1.40 μF/cm$^2$.

EXAMPLE 3

In the second stage etching solution as used in Comparative Example 1, polyvinylsulfonic acid (ion exchange capacity: 9.2 meq/g, molecular weight: 200,000) was dissolved in a proportion of 0.3 g/l, and etching and anodic oxidation were conducted and the capacity was measured, in the same manner as in Comparative Example 1, whereby the capacity was found to be 1.48 μF/cm$^2$.

EXAMPLE 4

In the second stage etching solution as used in Comparative Example 1, polystyrenephosphinic acid (ion exchange capacity: 2.7 meq/g, average molecular weight: 200,000) was dissolved in a proportion of 0.5 g/l, and etching and anodic oxidation were conducted and the capacity was measured, in the same manner as in Comparative Example 1, whereby the capacity was found to be 1.38 μF/cm$^2$.

EXAMPLE 5

In the second stage etching solution as used in Comparative Example 1, polystyrenesulfonic acid (ion exchange capacity: 5.4 meq/g, average molecular weight: 100,000) was dissolved in a proportion of 0.5 g/l, and etching and anodic oxidation were conducted and the capacity was measured, in the same manner as in Comparative Example 1, whereby the capacity was found to be 1.50 μF/cm$^2$.

COMPARATIVE EXAMPLE 2

Alternate current etching of an aluminum foil having a purity of 99.9% and a thickness of 100 μm was conducted in three stages under the following conditions.

Etching solution: an aqueous solution containing 7% by weight of HCl, 1% by weight of $H_3PO_4$, 1% by weight of $AlCl_3$ and 1% by weight of $HN0_3$.

First stage: solution temperature 30° C., frequency 30 Hz, quantity of electricity 4800 Coulomb/dm$^2$ Second stage:solution temperature 25° C., frequency 25 Hz, quantity of electricity 5400 Coulomb/dm$^2$ Third stage: solution temperature 20° C., frequency 20 Hz, quantity of electricity 3600 Coulomb/dm$^2$ Then, the aluminum foil was subjected to anodic oxidation treatment in an aqueous solution prepared by adding 100 of boric acid and 4 cc of 28 wt % aqueous ammonia in 1 l of pure water, by applying a direct current voltage of 50 V. Using the anode oxidation treated foil thus obtained, a capacitor for a test was prepared in the same manner as in Comparative Example 1, and the electrostatic capacity was measured, whereby the capacity was found to be 16.0 μF/cm$^2$.

EXAMPLE 6

In the third stage etching solution as used in Comparative Example 2, polystyrenesulfonic acid (ion exchange capacity: 5.4 meq/g, average molecular weight: 100,000) was dissolved in a proportion of 0.5 g/l, and etching and anodic oxidation were conducted and the capacity was measured, in the same manner as in Comparative Example 2, whereby the capacity was found to be 24.8 μF/cm$^2$.

COMPARATIVE EXAMPLE 3

An aluminum foil having a purity of 99.9% and a thickness of 100 μm was subjected to first stage etching by using, as a first stage etching solution, an aqueous solution having a hydrochloric acid concentration of 5% by weight and a sulfuric acid concentration of 25% by weight and having a solution temperature of 80° C. and by applying a direct current at a current density of 30 A/dm$^2$ for 120 seconds. Then, second stage etching was conducted by using, as a second stage etching solution, an aqueous solution having a nitric acid concentration of 7% by weight and having a liquid temperature of 70° C. and by applying a direct current at a current density of 10 A/dm$^2$ for 380 seconds. After the first stage and second stage etching, the aluminum foil was subjected to anodic oxidation in the same aqueous solution as used in Comparative Example 1 by applying a direct current voltage of 310 V, and the capacity was measured and found to be 1.20 μF/cm$^2$.

EXAMPLE 7

In the second stage etching solution as used in Comparative Example 3, the same sodium polyacrylate as used in Example 1 was dissolved in a proportion of 1.0 g/l, and etching and anodic oxidation were conducted and the capacity was measured, in the same manner as in Comparative Example 3, whereby the capacity was found to be 1.33 μF/cm$^2$.

EXAMPLE 8

In the second stage etching solution as used in Comparative Example 3, polystyrenephosphonic acid (ion exchange capacity: 5.0 meq/g, molecular weight: 200,000) was dissolved in a proportion of 1.0 g/l, and etching and anodic oxidation were conducted and the capacity was measured, in the same manner as in Comparative Example 3, whereby the capacity was found to be 1.45 μF/cm$^2$.

EXAMPLE 9

In the second stage etching solution as used in Comparative Example 3, polystyrenephosphinic acid (ion exchange capacity: 2.7 meq/g, average molecular weight: 200,000) was dissolved in a proportion of 1.0 g/l, and etching and anodic oxidation were conducted and the capacity was measured, in the same manner as in Comparative Example 3, whereby the capacity was found to be 1.48 $\mu F/cm^2$.

EXAMPLE 10

In the second stage etching solution as used in Comparative Example 3, polystyrenesulfonic acid (ion exchange capacity: 5.4 meq/g, average molecular weight: 100,000) was dissolved in a proportion of 0.5 g/l, and etching and anodic oxidation were conducted and the capacity was measured, in the same manner as in Comparative Example 3, whereby the capacity was found to be 1.53 $\mu F/cm^2$.

As described in the foregoing, according to the method of the present invention, etching holes can be etched to be deep and large and yet etching of the surface layer of the aluminum foil can be suppressed, and an etched aluminum foil having a remarkably large surface area can be obtained without impairing the mechanical strength of the foil. Accordingly, by using such an aluminum foil, it is possible to obtain a capacitor having a remarkably large electrostatic capacity.

What is claimed is:

1. A method for etching an aluminum foil for an aluminum electrolytic capacitor, which comprises immersing the aluminum foil in an etching solution containing a polymer electrolyte having cation exchange groups dissociable in the etching solution, and applying an electric current thereto.

2. The method according to claim 1, wherein the cation exchange groups are acid groups having a dissociation constant of less than 4.5.

3. The method according to claim 2, wherein the acid groups are selected from carboxylic acid groups, sulfonic acid groups, phosphonic acid groups and phosphinic acid groups.

4. The method according to claim 1, wherein the capacity of the cation exchange groups is from 0.001 to 20 meq/g dry polymer.

5. The method according to claim 1, wherein the polymer electrolyte has a molecular weight of at least 5000.

6. The method according to claim 1, wherein the polymer electrolyte is a polyvinylphosphonic acid, a polyvinylphosphinic acid, a polystyrenephosphonic acid, a polystyrenephosphinic acid, or a salt thereof.

7. The method according to claim 1, wherein the polymer electrolyte is a polyvinylsulfonic acid, a polystyrenesulfonic acid, a polytoluenesulfonic acid, a polynaphthalenesulfonic acid, a phenolsulfonic acid-aldehyde condensation product, or a salt thereof.

8. The method according to claim 1, wherein the amount of the polymer electrolyte in the etching solution is from 0.003 to 10 g/l.

9. The method according to claim 1, wherein the etching solution is an aqueous solution containing from 1 to 30% by weight of hydrochloric acid.

10. The method according to claim 9, wherein the etching solution contains from 0.5 to 2.0% by weight of an acid selected from the group consisting of sulfuric acid, phosphoric acid and oxalic acid.

11. The method according to claim 1, wherein the aluminum foil has a thickness of from 10 to 300 $\mu m$.

12. The method according to claim 1, wherein the aluminum foil for an aluminum electrolytic capacitor is for a medium or high voltage, and a direct current with a current density of from 1 to 50 $A/dm^2$ is applied.

13. The method according to claim 12, wherein the temperature of the etching solution is from 50° C. to 110° C.

14. The method according to claim 13, wherein etching is conducted in a plurality of stages, and the method is applied to etching in the second or subsequent stage.

15. The method according to claim 1, wherein the aluminum electrolytic capacitor is for a low voltage, and an alternate current of from 1000 to 7000 coulomb/$dm^2$ with a frequency of from 5 to 50 Hz is applied, and the temperature of the etching solution is from 5° C. to 50° C.

16. An aluminum foil for an aluminum electrolytic capacitor treated by the etching method of claim 1.

17. An aluminum foil for a medium or high voltage aluminum electrolytic capacitor treated by the etching method of claim 12.

18. The aluminum foil for a low voltage aluminum electrolytic capacitor treated by the etching method of claim 15.

19. An anodized aluminum foil for an aluminum electrolytic capacitor, which is obtained by anodic oxidation treatment of an aluminum foil treated by the etching method of claim 1.

20. An anodized aluminum foil for a medium or high voltage aluminum electrolytic capacitor, which is obtained by anodic oxidation treatment of an aluminum foil treated by the etching method of claim 12.

21. An anodized aluminum foil for a low voltage aluminum electrolytic capacitor, which is obtained by anodic oxidation treatment of an aluminum foil treated by the etching method of claim 15.

22. An aluminum electrolytic capacitor using the anodized aluminum foil of claim 19.

23. A medium or high voltage aluminum electrolytic capacitor using the anodized aluminum foil of claim 20.

24. A low voltage aluminum electrolytic capacitor using the anodized aluminum foil of claim 21.

* * * * *